United States Patent [19]

Deuring et al.

[11] Patent Number: 4,825,824

[45] Date of Patent: May 2, 1989

[54] VALVE CLEARANCE ADJUSTING DEVICE

[75] Inventors: Hans Deuring, Burscheid; Klaus Pesch, Leverkusen, both of Fed. Rep. of Germany

[73] Assignee: Goetze AG, Burscheid, Fed. Rep. of Germany

[21] Appl. No.: 17,041

[22] Filed: Feb. 12, 1987

Related U.S. Application Data

[63] Continuation-in-part of Ser. No. 847,229, Apr. 2, 1986, Pat. No. 4,656,978.

[30] Foreign Application Priority Data

Feb. 13, 1986 [DE] Fed. Rep. of Germany ..... 3604479
Mar. 3, 1986 [DE] Fed. Rep. of Germany ..... 3606824

[51] Int. Cl.[4] ..... F01L 1/24
[52] U.S. Cl. ..... 123/90.58
[58] Field of Search ..... 123/90.55, 90.58, 90.59, 123/90.43, 90.46

[56] References Cited

U.S. PATENT DOCUMENTS

| | | | |
|---|---|---|---|
| 4,397,271 | 8/1983 | Gardner | 123/90.58 |
| 4,590,899 | 5/1986 | Kowal et al. | 123/90.55 |
| 4,640,238 | 2/1987 | Camosso et al. | 123/90.58 |
| 4,656,978 | 4/1987 | Deuring | 123/90.55 |
| 4,686,947 | 8/1987 | Speil | 123/90.58 |
| 4,688,526 | 8/1987 | Buente et al. | 123/90.58 |

FOREIGN PATENT DOCUMENTS

| | | | |
|---|---|---|---|
| 0145445 | 6/1985 | European Pat. Off. . | |
| 0156260 | 10/1985 | European Pat. Off. . | |
| 0197246 | 10/1986 | European Pat. Off. . | |
| 2517370 | 4/1975 | Fed. Rep. of Germany . | |
| 3203792 | 11/1982 | Fed. Rep. of Germany . | |
| 43275 | 3/1980 | Japan | 123/90.58 |

*Primary Examiner*—Willis R. Wolfe
*Assistant Examiner*—M. Macy
*Attorney, Agent, or Firm*—Spencer & Frank

[57] ABSTRACT

Method of oil and gas tightly fastening a diaphragm made of an elastomer material with respect to the tappet as well as the adjusting element within a hydrostatic valve clearance adjusting device and configuration of the same. Clamping rings are form-lockingly connected with the fastening end of the diaphragm already during the vulcanization process. The thus manufactured installable unit is fixed in the tappet in the correct position orientation by means of an installation tool. Moreover, the structural configuration of the clamping rings is described as well as that of the elastic diaphragm.

14 Claims, 3 Drawing Sheets

VALVE CLEARANCE ADJUSTING DEVICE

This application is a continuation-in-part of copending application Ser. No. 847,229 filed Apr. 2, 1986, now U.S. Pat. No. 4,656,978 filed Apr. 14, 1987.

BACKGROUND OF THE INVENTION

The present invention relates to a method for oil and gas tightly fastening a diaphragm made of an elastomer material to a tappet as well as to an adjusting element disposed within a hydrostatic valve clearance adjusting device, particularly for internal-combustion engines.

FRG-OS [Laid-open Application] No. 2,517,370 discloses a hydraulic clearance adjusting device, particularly for controlling the valves of internal-combustion engines. A tappet having an approximately U-shaped cross section cooperates with the engine camshaft. An axially displaceable piston is disposed in the interior of the tappet so as to define a pressure chamber enclosed within the tappet. Within the pressure chamber there are provided a plurality of individual components which form the valve clearance adjusting element. The pressure chamber which is filled completely with a hydraulic operating medium is sealed by means of a substantially tubular elastic diaphragm.

The valve clearance adjusting element is composed of a plurality of individual parts which must be individually installed during assembly of the valve clearance adjusting device. Such system cannot be used for tappet stems operating with a closed hydraulic system.

SUMMARY OF THE INVENTION

It is an object of the invention to provide a seal for hydrostatic valve clearance adjusting devices and an installation method with which the assembly of the sealing diaphragm can be facilitated.

This is accomplished by the present invention in that, in the region of the fastening ends of the diaphragm, clamping rings are provided in a form locking manner and the diaphragm is mounted in the valve clearance adjusting device by means of a tool which engages at the clamping rings.

To generate the form-locking connection between the clamping ring and the diaphragm, the clamping ring is preferably inserted into the vulcanizing mold required to manufacture the diaphragm and, during filling of the mold cavity, the diaphragm to be produced is matched exactly to the shape of the clamping ring so that, after vulcanization of the diaphragm, the latter can then be removed from the vulcanization tool together with the form-lockingly connected clamping ring and can then be installed in the valve cup.

To increase the radial clamping effect in the installed state, i.e. to realize good radial tensioning in the elastomer material, the fastening ends of the diaphragm may be thickened in the form of a bead and between the two beadshaped fastening ends the diaphragm has a thinner cross section. To further support the seal of the hydraulic chamber defined by the diaphragm, radially bent sealing lips can be provided for the fastening ends of the diaphragm.

The requirement for flexibility of the system over a temperature range from −50° C. to +200° C. necessitates the use of silicone or fluorosilicone rubber. It is known that metal components cannot be durably vulcanized to such materials. By replacing the customary vulcanized-in reinforcement rings with the clamping rings according to the invention, which are placed partially into the diaphragm in a form-locking manner, the above-mentioned rubber materials can be used for the diaphragm.

According to a further feature of the invention, the element which clamps in the outer circumferential region of the valve clearance adjusting element is an approximately tubular metal component. To be able to not only radially clamp in the valve clearance adjusting element, which is a one-piece body, but also to secure it against axial slippage during transport and assembly of the complete valve clearance adjusting device, it is further proposed to provide the tube with a bottom which is preferably axially set back in the direction of the valve clearance adjusting element. Thus, the entire region between valve and camshaft is sealed, simultaneously providing good axial guidance for the valve clearance adjusting element as well as for the valve stem which is stepped in this region.

The transition of the tubular region into the bottom results in an approximately semicircular cross section.

The entire body can be manufactured in a simple manner as a deep-drawn component, with the open region of the U-shaped metal member, when seen in the installed state, being oriented axially in the direction of the valve clearance adjusting element.

The form-locking connection of the tubular metal member produces undercut end regions, i.e., it partially encloses the elastic diaphragm. The transitions between metal member and diaphragm are here configured in such a manner that a secure seat and reduction of elastomer stresses are assured.

To transfer the torque between tappet and adjusting element, or, more precisely, the valve stem, the clamping ring which cooperates with the tappet can also be given a tubular shape and provided with an undercut section that is enclosed by the diaphragm body. Since no vulcanization exists between the radially outer bead and the clamping ring, but rather a form-locking connection, the clamping ring may be made of metal or plastic.

To provide for proper installation, the clamping ring is bent at an angle in the region of its radially outer axial extent and is provided with a circumferential groove to accommodate the assembly tool.

To produce an axial arrest of the clamping ring in the tappet, a further feature of the invention offers the advantage that the angled region of the clamping ring engages in a corresponding groove of the tappet. Instead of the groove, radially arranged projections could also be provided along the inner circumference, with such projections preventing slippage in the manner of a ramp and permitting axial hooking of the clamping ring. Moreover, the radial projections could also be disposed along the entire inner circumference of the tappet.

After the clamping ring is snapped into the groove, a defined pressure exists at the sealing faces of the tappet bottom, thus assuring a permanently tight seat of the diaphragm in the tappet.

The described arrangement results in the advantage that the diaphragm forms an installable unit together with the clamping rings, a unit which is particularly easy to manipulate for final installation into an internal-combustion engine. The invention further assures reliable oil and gas tightness even under the influence of changing temperatures, since the form-locking connection remains stably in place.

FIGS. *2a* and *2b* are cross-sectional views of respective stages in the assembly of the diaphragm of such device.

Figure 3:
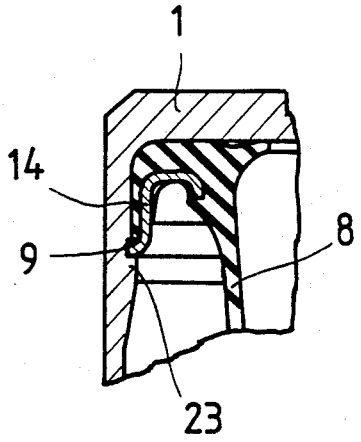

FIG. 3 is a detail view illustrating the snap-in connection of the diaphragm.

DESCRIPTION OF THE PREFERRED EMBODIMENTS

Figure 1:
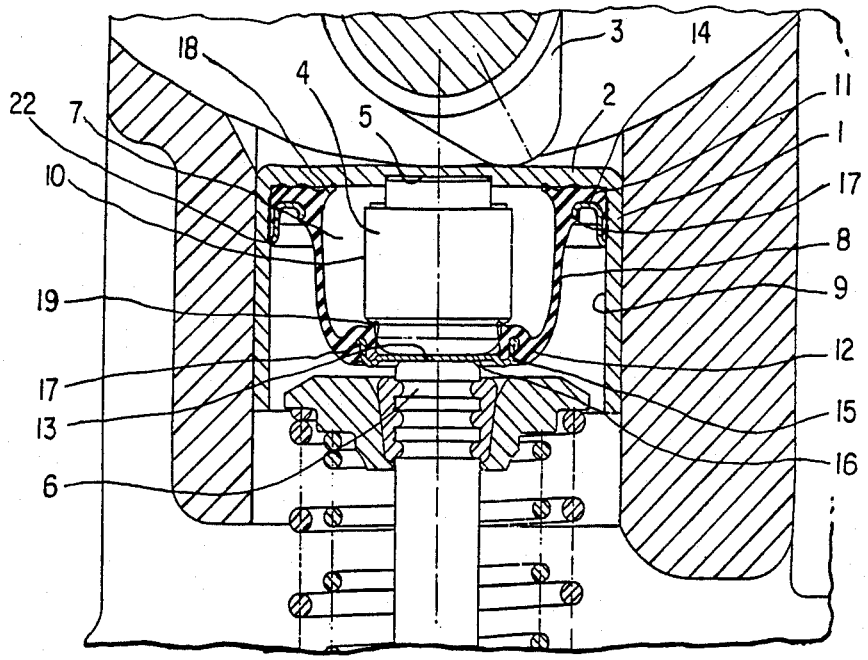
FIG. 1 is a cross-sectional view of a valve clearance adjusting device according to the invention.
Figure 2B:
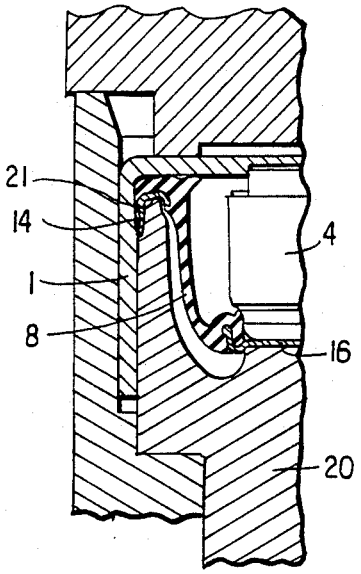
Figure 2A:
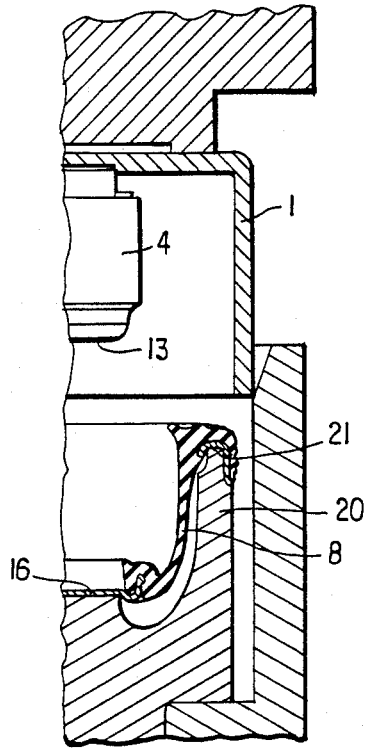

The valve clearance adjusting device shown in FIG. 1 is composed of a tappet 1 having an approximately U-shaped cross section and a bottom 2 which cooperates with a camshaft 3. Radially within tappet 1, there is disposed a known, one-component valve clearance adjusting element 4 (not shown in detail) which cooperates, on the one hand, with the inner frontal face 5 of the bottom 2 and, on the other hand, with a valve stem 6.

To seal the pressure chamber 7 which is filled with an incompressible medium, an elastic diaphragm 8 is provided which extends essentially radially between the outer circumferential face 10 of valve clearance adjusting element 4 and the inner circumferential face 9 of tappet 1.

At its radial end regions 11 and 12, diaphragm 8 has a thickened bead shape and is held in the proper position and orientation by means of additional clamping rings 13 and 14 which perform a radial clamping action. Diaphragm 8 is made of a fluorosilicone rubber.

Clamping ring 13, which clamps the radially inwardly disposed bead 12, is composed of a deep-drawn metal component which has a tubular external region 15.

To axially support valve clearance adjusting element 4, clamping ring 13 is provided with an axially set back bottom 16. The ends of the tubular region 15 of clamping ring 13 are undercut, or bent outwardly, at 17 and are form-lockingly connected with the bead 12 of diaphragm 8.

The clamping ring 14 disposed in bead 11 is bent at an angle and is likewise undercut at 17.

To support the sealing effect, sealing lips 18 and 19 are provided at the fastening ends 11 and 12 of diaphragm 8 and are radially bent in the direction of adjusting element 4.

FIGS. *2a* and *2b* show diaphragm 8 before and after assembly, respectively. Before assembly, a circumferential groove 21 of clamping ring 14 as well as the bottom 16 of clamping ring 13 are supported on a tool 20. Due to the fact that tool 20 enters into tappet 1, as shown in FIG. *2b*, valve adjusting element 4 and diaphragm 8 are positioned accurately.

FIG. 3 shows a structure for a snap-in connection for axially fastening diaphragm 8 in tappet 1. During assembly, diaphragm 8 is pressed over a circumferential radial projection 23 which functions as a ramp. As soon as the end of the ramp is reached, clamping ring 14 snaps radially outwardly in a groove in the inner circumference 9 of tappet 1, so that diaphragm 8 is arrested axially and prevented from slipping out.

The invention now being fully described, it will be apparent to one of ordinary skill in the art that many changes and modifications can be made thereto without departing from the spirit or scope of the invention as set forth herein.

The present disclosure relates to the subject matter disclosed in German Applications No. P 36 06 824.1 of Mar. 3, 1986 and P No. 36 04 479.2 of Feb. 13, 1986, the entire specifications of which are incorporated herein by reference.

What is claimed is:

1. A valve clearance adjusting device comprising a diaphragm composed of a body of elastomer material and inner and outer clamping rings fastened to said elastomer body so as to be interlocked therewith, a tappet surrounding said diaphragm and a valve clearance adjusting element surrounded by said diaphragm, said diaphragm forming a fluid-tight seal with both tappet and said adjusting element, with said diaphragm being fabricated by molding elastomer material in a mold containing the clamping rings so that elastomer material surrounds a part of each ring, and vulcanizing the elastomer material to interlock the body of elastomer material to the clamping rings, and said diaphragm being installed in said tappet by means of a tool which engages said clamping rings, wherein said body of elastomer material has two opposed edges, said clamping rings are each disposed at a respective diaphragm edge, and each said edge is constituted by a thickened region having the form of a bead, said body of elastomer material has a main portion extending between said edges and having a thickness less than that of said thickened regions, said elastomer body is provided at each said thickened region with a sealing lip extending radially toward said adjusting element, said elastomer body is composed of a flexible and temperature resistant silicone or fluorosilicone rubber, said inner clamping ring is adjacent said adjusting device and has the form of an at least approximately tubular metal component, and said inner clamping ring has a closed bottom supporting said adjusting device.

2. A device as defined in claim 1 wherein said closed bottom of said inner clamping ring has an approximately U-shaped cross section and is set back toward said adjusting element.

3. A device as defined in claim 2 wherein said inner clamping ring further has a tubular portion located at the circumference of said element and embedded in said elastomer body, and a transition portion having an at least approximately semicircular cross section and joining said tubular portion to said closed bottom.

4. A device as defined in claim 3 wherein said inner clamping ring has an open region oriented axially toward said adjusting element.

5. A device as defined in claim 4 wherein only said tubular portion of said inner clamping ring is connected in an interlocking manner to the associated thickened region of said elastomer body.

6. A device as defined in claim 5 wherein said tubular portion of said inner clamping ring has a free edge which is bent over to form an undercut structure.

7. A device as defined in claim 6 wherein said outer clamping ring is adjacent said tappet and aids formation of the fluid-tight seal between said diaphragm and said tappet, and said outer clamping ring has an angular cross section and a free end embedded in said bead at said diaphragm edge at which said outer clamping ring is disposed, said free end being bent over radially inwardly to form an undercut structure.

8. A device as defined in claim 7 wherein said outer clamping ring has an external circumferential edge at which said ring is bent at an angle in the direction of said tappet.

9. A device as defined in claim 8 wherein said tappet has an inner circumferential face and said external circumferential edge of said outer clamping ring contacts said tappet at said inner circumferential face.

10. A device as defined in claim 9 wherein said tappet has a groove in said inner circumferential face in which said external circumferential edge of said outer clamping ring engages.

11. A device as defined in claim 10 wherein said tappet is provided, at said inner circumferential face, with means defining a ramp past which said external circumferential edge of said outer clamping ring slides to engage into said groove during installation of said diaphragm in said tappet.

12. A device as defined in claim 11 wherein said means defining a ramp comprise a plurality of radial projections spaced apart circumferentially on said inner circumferential face of said tappet.

13. A device as define in claim 12 wherein said clamping rings are made of metal.

14. A device as defined in claim 12 wherein said clamping rings are made of plastic.

* * * * *